United States Patent [19]

Kaiser, Jr.

[11] 4,213,131

[45] Jul. 15, 1980

[54] SCANNABLE BEAM FORMING INTERFEROMETER ANTENNA ARRAY SYSTEM

[75] Inventor: Julius A. Kaiser, Jr., Kensington, Md.

[73] Assignee: The United States of America as represented by the Administrator of the National Aeronautics and Space Administration, Washington, D.C.

[21] Appl. No.: 39,031

[22] Filed: May 14, 1979

[51] Int. Cl.[2] ..... H01Q 3/26

[52] U.S. Cl. ..... 343/844; 343/100 SA; 343/854

[58] Field of Search ..... 343/844, 853, 854, 100 SA, 343/100 CL, 100 LE

[56] References Cited

U.S. PATENT DOCUMENTS 3,766,559 10/1973 Butcher et al. ..... 343/100 SA

*Primary Examiner*—Eli Lieberman

*Attorney, Agent, or Firm*—Ronald F. Sandler; John R. Manning; John O. Tresansky

[57] ABSTRACT

An antenna array comprising at least three interferometer pairs of antenna elements with selected spacings made to form a single beam which is readily scannable. All spatial frequencies generated by a signal and intercepted by the array are derived from a signal processing technique applied to the array. The array samples space in the spatial frequency domain while the signal processing technique utilizes real time convolution of functions in the spectral frequency domain. Summation of the appropriate spatial frequencies is equivalent to a Fourier transform operation, yielding the location of the signal source in space. Resolution and freedom from interference of the interferometer system is equal to that of a fully filled array of the same aperture size containing element spacings of one-half wavelength. An antenna array system comprising four antenna elements forming six interferometer pairs with a resolution equal to that of a sixteen element array with spacings of one-half wavelength is described, as well as other multiples of one-quarter wavelength or partial multiples of a wave length.

9 Claims, 1 Drawing Figure

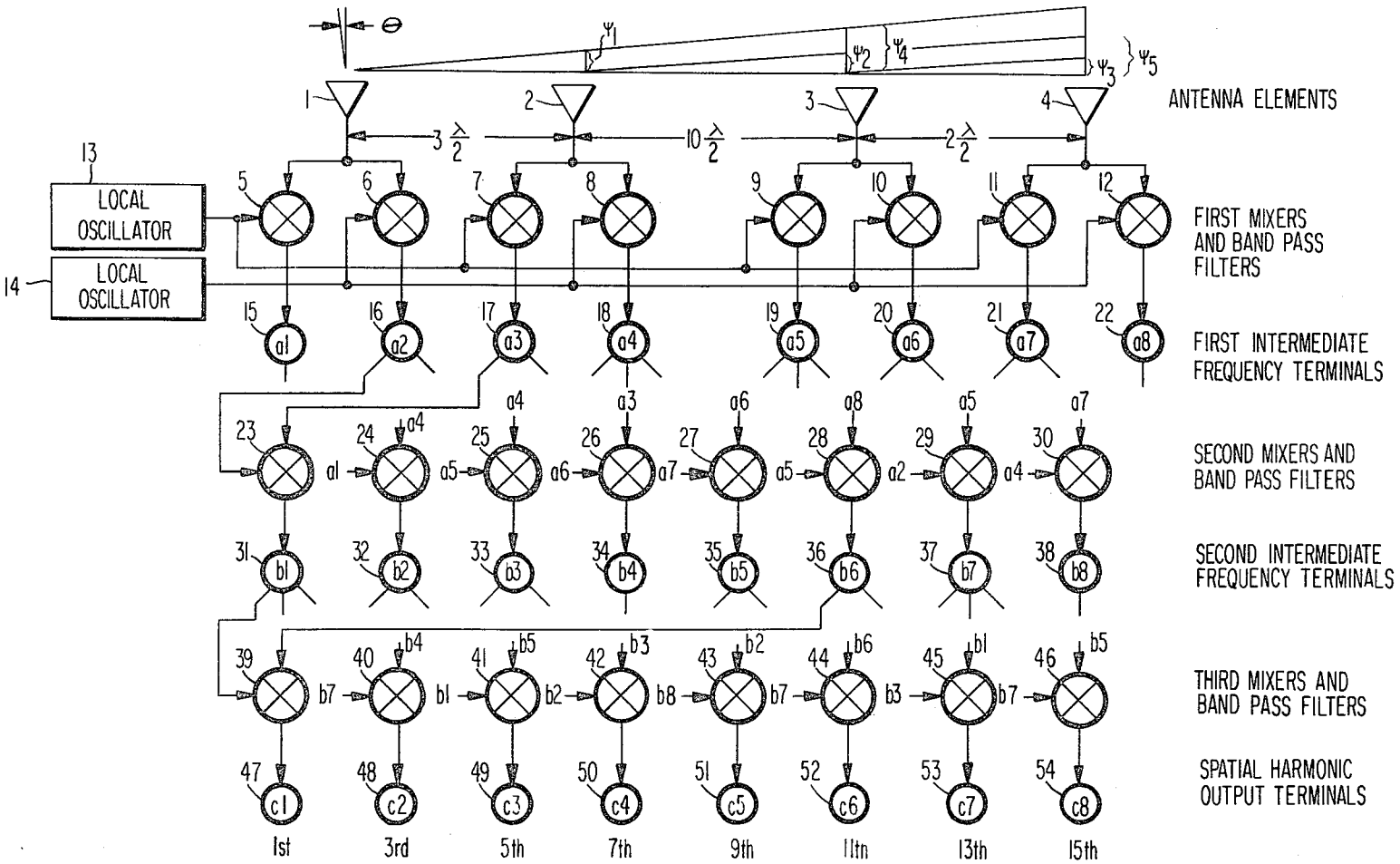
ANTENNA ELEMENTS
FIRST MIXERS AND BAND PASS FILTERS
FIRST INTERMEDIATE FREQUENCY TERMINALS
SECOND MIXERS AND BAND PASS FILTERS
SECOND INTERMEDIATE FREQUENCY TERMINALS
THIRD MIXERS AND BAND PASS FILTERS
SPATIAL HARMONIC OUTPUT TERMINALS
LOCAL OSCILLATOR
LOCAL OSCILLATOR
1st
3rd
5th
7th
9th
11th
13th
15th

SCANNABLE BEAM FORMING INTERFEROMETER ANTENNA ARRAY SYSTEM

ORIGIN OF THE INVENTION

The invention described herein was made by an employee of the United States Government and may be manufactured and used by and for the Government for governmental purposes without the payment of any royalties thereon or therefor.

BACKGROUND OF THE INVENTION

The present invention generally relates to interferometers for determining the spatial direction of incoming radio waves referenced to an array of spaced antenna elements, and more particularly to an interferometer wherein all spatial frequencies generated by a signal and intercepted by the array are derived from a signal processing technique which utilizes real time convolution of functions in the spectral frequency domain. The signal processing technique is applied to an array of widely spaced pairs of antenna elements in order to form a single beam which is readily scannable. The system circumvents the shortcomings normally encountered in using interferometers, such as ambiguities which arise due to grating lobes and extreme vulnerability to interference due to the difficulty or inability for the interferometer to readily distinguish between two signals within the array system's field of view and within the receiver passband. The signal processing technique according to the invention differs from systems that sample spatial location, as practiced by collimating reflector systems and phased arrays, and from those systems which sample all spatial locations simultaneously, as practiced in adaptive array systems.

SUMMARY OF THE INVENTION

It is therefore an object of this invention to provide a scannable beam-forming interferometer antenna array system which uses a signal processing technique that eliminates ambiguities and reduces the vulnerability to interference normally encountered in such systems.

It is another object of the invention to provide a scannable beam-forming interferometer antenna array system which uses a minimum number of antenna elements spaced in such a manner that the spatial frequencies of an array having a larger number of antenna elements can be derived without ambiguity.

According to the present invention, the scannable beam-forming interferometer antenna array system comprises a plurality of antenna elements spaced from one another by integral multiples of a fractional wavelength of the signal frequency, at least three pairs of antenna elements being selectable from the plurality of antenna elements. The spacings between the interferometer pairs are selected such that all desired spatial frequencies which are generated by a signal and intercepted by the array can be resolved. Signal processing begins by dividing the signals from each antenna element into two parts and, by using two coherent local oscillators, translating the antenna signals to first intermediate frequency signals. Selected pairs of first intermediate frequency signals are combined to form the interferometer pairs and obtain outputs having spatial frequencies determined by the spacing between the corresponding interferometer pairs. These spatial frequency signals are second intermediate frequency signals and are further mixed to produce the desired spatial frequencies at a third intermediate frequency. Summation of these third intermediate frequency signals yields spatial location with resolution and freedom from interference equal to that of a fully filled aperture of the same dimensions with similar element spacings.

The beam-forming interferometer array system according to the invention makes use of the spatial frequency/spatial location transform pair and involves the sampling and processing of signals in the spatial frequency domain. Each of the spatial frequencies resolved appear at an intermediate frequency level with all spatial phase information preserved; frequency and phase modulation associated with the arriving signal, however, are generally removed. The spatial frequencies are coherently summed to form a single beam and, thus, uniquely define the direction of the arriving signal. This summing process can be performed within the system or in space. The latter summation is accomplished by applying the processed spatial phase information to a fully filled transmit array, making the overall system a retro-directive array with a single beam returned in the direction of the signal source. This becomes a retro-directive system which requires no phase shifters, weighting circuits or scan controllers. In the former application, the beam formed by summing the spatial frequencies within the system may be steered by using intermediate frequency phase shifters where the number of phase shifters required would be one-half the number of radio frequency phase shifters required to scan an equivalent fully filled array at radio frequency. Alternatively, using the array phasing device described by R. J. Mailloux et al in "An Array Phasing Device Which Uses Only One Phase Shifter For Each Direction of Scan", *AP Transactions,* March 1968, pp. 258–260, beam steering can be accomplished by using only one phase shifter per direction of scan.

BRIEF DESCRIPTION OF THE DRAWING

The invention will be better understood from the following detailed description of a preferred embodiment which makes reference to the drawing in which the sole FIGURE is a block diagram of a four element interferometer array system according to the invention.

DESCRIPTION OF THE PREFERRED EMBODIMENT

A linear array of four antenna elements 1, 2, 3 and 4 is illustrated in the drawing. This array provides six pairs of antenna elements. In other words, six different pairs of antenna elements can be selected from the linear array of four elements shown in the FIGURE. More generally, if the symbol $$\binom{n}{2}$$

denotes the number of pairs of antenna elements which may be selected from an array n elements, then according to the invention $$\binom{n}{2} \geqq 3.$$

For any array of n antenna elements, the number of pairs can be computed from the following formula:

$$\binom{n}{2} = \frac{n!}{2(n-2)!}$$

Using the above equation, the number of pairs in the illustrated embodiment are computed as follows:

$$\frac{4!}{2(4-2)!} = \frac{24}{4} = 6$$

As shown in the FIGURE, the antenna elements 1,2,3 and 4 are relatively widely spaced. More specifically, antenna elements 1 and 2 are spaced $3\lambda/2$, antenna elements 2 and 3 are spaced $10\lambda/2$, and antenna elements 3 and 4 are spaced $2\lambda/2$. In general, these spacings are selected such that all desired spatial frequencies which are generated by a signal intercepted by the array can be resolved. Spacings may be, for example, multiples of one-quarter wavelength or partial multiples of a wavelength. Arbitrarily, chosing antenna element 1 as being the reference, the incident signal $\omega_s$ having a frequency or phase modulation $\phi_m$ is illustrated as having a direction $\theta$ from the normal to the baseline established by the antenna element array. Thus, for the reference antenna element 1, the antenna signal is cos $(\omega_s+\phi_m)t$, but the antenna signal for antenna element 2 is cos $[(\omega_s+\phi_m)t+\Psi_1]$. In other words, the signal from antenna 2 appears to be modulated by $\Psi_1$ which is a spatial frequency determined by the spacing between antenna elements 1 and 2. $\Psi_1$ corresponds to the third spatial harmonic since antenna elements 1 and 2 are separated by $3\lambda/2$. Similarly, as shown in the drawing, $\Psi_2$ is a spatial frequency determined by the spacing between antenna elements 2 and 3, $\Psi_3$ is a spatial frequency determined by the spacing between antenna elements 3 and 4, $\Psi_4$ is a spatial frequency determined by the spacing between antenna elements 1 and 3, and $\Psi_5$ is a spatial frequency determined by the spacing between antenna elements 2 and 4. Also, the following relationships are true:

$$\Psi_4=\Psi_1+\Psi_2$$
$$\Psi_5=\Psi_2+\Psi_3$$

Thus, the antenna signal for antenna element 3 is cos $[(\omega_s+\phi_m)t+\Psi_4]$, and the signal for antenna element 4 is cos $[(\omega_s+\phi_m)t+\Psi_4+\Psi_3]$. $\Psi_4$ corresponds to the thirteenth spatial harmonic since antenna elements 1 and 3 are separated by $13\lambda/2$, and $\Psi_4+\Psi_3$ corresponds to the fifteenth spatial harmonic since antenna elements 1 and 4 are separated by $15\lambda/2$. In general there is a spatial harmonic for each $\lambda/2$, but in the antenna array shown in the drawing, some of these harmonics are missing. More specifically, in the preferred embodiment illustrated in the drawing, the odd spatial harmonics are used to determine spatial direction of the incoming signal, and those harmonics which are missing, such as the first, seventh, ninth and so forth, are derived by the signal processing technique to be described.

It will, of course, be understood that the signals from antenna elements 2, 3 and 4 appear to have the indicated spatial frequency modulations only by virtue of the selection of antenna element 1 as the reference and the selection of the specific interferometer pairs to be described hereinafter. In other words, selection of a different antenna element as the reference and a different selection of interferometer pairs will result in different apparent spatial frequency modulations of the antenna signals from each of the several antenna elements. Thus, it will be appreciated the specific number of antenna elements and spacings and choice of interferometer pairs as disclosed herein is by way of illustration only, and other different numbers and spacings of antenna elements and choice of interferometer pairs will produce different apparent spatial frequency modulations on each of the antenna element signals.

The signals from each antenna element are divided into two parts and translated to first intermediate frequency signals. More specifically, a first plurality of mixers and bandpass filters 5 to 12 are provided. Antenna element 1 is connected to mixers 5 and 6, antenna element 2 is connected to mixers 7 and 8, and so forth. Two coherent local oscillators 13 and 14 provide output signals to this first plurality of mixers 5 to 12. Specifically, local oscillator 13 is connected to mixers 5, 7, 9 and 11, while local oscillator 14 is connected to mixers 6, 8, 10 and 12. The local oscillator frequencies can be chosen to be either both above or both below the signal frequency when the incident modulation is to be removed. When the incident modulation is to be retained, the local oscillator frequencies are chosen such that one is above the signal frequency and the other is below the signal frequency. Assume, for example, that the signal frequency is 2.1 GHz and the frequency of local oscillator 13 is 1.66 GHz while the frequency of local oscillator 14 is 1.72 GHz. Under this assumption, the intermediate output frequency of mixers 5, 7, 9 and 11 is 440 MHz, and the intermediate output frequency from the mixers 6, 8, 10 and 12 is 380 MHz. The 440 MHz intermediate frequency will be designated as $\omega_{IF11}t$ and the intermediate frequency 380 MHz will be designated as $\omega_{IF12}t$. The output signal frequencies of mixers 5 to 12 are shown in Table 1.

TABLE I

| OUTPUTS OF FIRST MIXERS | |
|---|---|
| Mixer No. | Output |
| 5 | $(\omega_{IF_{11}}+\phi_m)t$ |
| 6 | $(\omega_{IF_{12}}+\phi_m)t$ |
| 7 | $(\omega_{IF_{11}}+\phi_m)t+\psi_1$ |
| 8 | $(\omega_{IF_{12}}+\phi_m)t+\psi_1$ |
| 9 | $(\omega_{IF_{11}}+\phi_m)t+\psi_4$ |
| 10 | $(\omega_{IF_{12}}+\phi_m)t+\psi_4$ |
| 11 | $(\omega_{IF_{11}}+\phi_m)t+\psi_4+\psi_3$ |
| 12 | $(\omega_{IF_{12}}+\phi_m)t+\psi_4+\psi_3$ |

The outputs of mixers 5 to 12 are connected to terminals 15 to 22. These terminals are designed a1 to a8, respectively.

Having translated the signal from each antenna element to two different first intermediate frequency signals, the next step is to form interferometer pairs. The interferometer pairs are formed by mixing the first intermediate frequency signals from two different antenna elements in a plurality of second mixers and bandpass filters 23 to 30. The first intermediate frequency signals to be mixed in this second plurality of mixers are always of different frequencies so that the mixer outputs will be at the different frequency, in other words at a second intermediate frequency. In the example being considered, mixing first intermediate frequency signals of 440 MHz and 380 MHz results in a difference frequency of 60 MHz. The designations a1 to a8 for terminals 15 to 22 are used to indicate the inputs to the second plurality of mixers and bandpass filters 23 to 30. For example, as specifically illustrated in the drawing, the inputs to mixer 23 are connected to terminals a2 and a3. Following this convention, the inputs to mixer 24 are connected to terminals a1 and a4, and so forth. The 60 MHz second intermediate frequency will be designated $\omega_{IF2}t$. Thus, outputs of mixers 23 to 30 are shown in Table 2.

Table 2

| OUTPUTS OF SECOND MIXERS | |
|---|---|
| Mixer No. | Output |
| 23 | $\omega_{IF_2}t + \psi_1$ |
| 24 | $\psi_1 - \omega_{IF_2}t$ |
| 25 | $\omega_{IF_2}t + \psi_2$ |
| 26 | $\psi_2 - \omega_{IF_2}t$ |
| 27 | $\omega_{IF_2}t + \psi_3$ |
| 28 | $\psi_3 - \omega_{IF_2}t$ |
| 29 | $\omega_{IF_2}t + \psi_4$ |
| 30 | $\omega_{IF_2}t + \psi_5$ |

The interferometer pairs so formed appear at terminals 31 to 38, which are designated at b1 thru b8, respectively, again for purposes of indicating subsequent connections. It may be noted at this point that when the higher frequency first intermediate frequency signal from antenna element 2 is mixed with the lower first intermediate frequency signal from antenna element 1 in mixer 23, a normal function, cos $(\omega_{IF2}+\Psi_1)t$, is obtained. On the other hand, when that interferometer pair is formed using the other first intermediate frequency signals available in mixer 24, an inverted signal, cos $(\Psi_1-\omega_{IF2})t$, is obtained. Similarly, all interferometer pairs may be formed with either normal or inverted functions. It may also be noted that in each interferometer pair, the phase/frequency modulation argument is no longer present. If it is desired to recover the modulation, $\phi_m$, then an additional local oscillator is required.

Each interferometer pair generates grating lobes which are nothing more than a spatial frequency which is determined by the spacing between that pair. One may mix spatial frequencies to obtain still other spatial frequencies. Since the second intermediate frequencies signals are all the same frequency, i.e., 60 MHz, mixing two interferometer pairs produces a signal at a third intermediate frequency, e.g., at the sum of the two frequencies or 120 MHz. This is accomplished in a third plurality of mixers and bandpass filters 39 to 46. As before, the terminal designations b1 to b8 are used to designate the inputs to each of the mixers 39 to 46. For example, by mixing the inverted signal for interferometer pair composed of antenna elements 3 and 4 at terminal 36 (b6) with the normal function signal from the interferometer pair composed of antenna elements 1 and 2 at terminal 31 (b1), there is generated at the output of mixer 39 the difference between the two arguments $(\Psi_1-\Psi_3)$ at the third intermediate frequency. Since $\Psi_1$ is generated by an interferometer pair with a $3\lambda/2$ spacing and $\Psi_3$ with a $2\lambda/2$ spacing, the difference, i.e., $(\Psi_1-\Psi_3)$, is a function proportional to an interferometer pair with a spacing of $\lambda/2$. This is the fundamental or first spatial harmonic. Had signals from these interferometer pairs been chosen such that both functions were normal, the sum of the arguments $(\Psi_3+\Psi_1)$ would be obtained, producing the fifth spatial harmonic at the output of mixer 41. Similarly, other odd spatial harmonics are generated by utilizing sums or differences of the various interferometer pairs as shown in Table 3.

Table 3

| DERIVATION OF SPATIAL HARMONICS | | | |
|---|---|---|---|
| Spatial Harmonic | Interferometer Spacings | Interferometer Pairs | |
| 1st | $3\lambda/2 - 2\lambda/2$ | 1,2 | 3,4 |
| 3rd | $13\lambda/2 - 10\lambda/12$ | 1,3 | 2,3 |
| 5th | $3\lambda/2 + 2\lambda/2$ | 1,2 | 3,4 |
| 7th | $10\lambda/2 - 3\lambda/2$ | 2,3 | 1,2 |
| 9th | $12\lambda/2 - 3\lambda/2$ | 2,4 | 1,2 |
| 11th | $13\lambda/2 - 2\lambda/2$ | 1,3 | 3,4 |
| 13th | $10\lambda/2 + 3\lambda/2$ | 2,3 | 1,2 |
| 15th | $13\lambda/2 + 2\lambda/2$ | 1,3 | 3,4 |

From Table 3, the outputs of mixers 39 to 46 at terminals 47 to 54 are shown in Table 4.

Table 4

| OUTPUTS OF THIRD MIXERS | |
|---|---|
| Mixer No. | Output |
| 39 | $\omega_{IF_3}t + \psi_1 - \psi_3$ |
| 40 | $\omega_{IF_3}t + \psi_4 - \psi_2$ |
| 41 | $\omega_{IF_3}t + \psi_3 + \psi_1$ |
| 42 | $\omega_{IF_3}t + \psi_2 - \psi_1$ |
| 43 | $\omega_{IF_3}t + \psi_5 - \psi_1$ |
| 44 | $\omega_{IF_3}t + \psi_4 - \psi_3$ |
| 45 | $\omega_{IF_3}t + \psi_2 + \psi_1$ |
| 46 | $\omega_{IF_3}t + \psi_4 + \psi_3$ |

Retro-directivity is achieved by applying these arguments and their conjugates to a fully filled transmit array with half wavelength spacings. In other words, a radio frequency carrier is modulated by $\Psi_1$ and its conjugate, and these signals are applied to the inner most pair of the transmit array; $\Psi_2$ and its conjugate are applied to the next pair out from the center, and so forth. The eight odd harmonics derived from the four element interferometer array are thus positioned to phase a fully filled sixteen element transmit array.

Summation of these odd spatial harmonics within the system on the other hand, derived from the four element interferometer array, produces a resolution equal to that from a uniform sixteen element array with one-half wavelength spacings. Scanning of the beam is achieved simply by changing the relative phases of the various spatial harmonics (at 120 MHz) before summing, thereby requiring only one-half the number of phase shifters that would have been required at radio frequency to scan a fully filled sixteen element array. The output voltage from the system represents an aperture illumination function which was generated by a signal source from only one direction in space. The system, thereby, accomplishes a Fourier transform operation.

The invention has been described in terms of a specific illustrative preferred embodiment, and those skilled in the art will understand that the invention can be practiced in other and different ways. For example, a two dimentional array could be used instead of the illustrated linear array. Different numbers and spacings of antenna elements can be used, and even spatial harmonics can be generated instead of or in addition to the odd spatial harmonics to determine the direction of an incoming radio wave. An important point to be appreciated, however, is that the processing technique according to the invention provides a resolution and freedom from interference equal to that of a fully filled array without the ambiguities normally associated with interferometers.

What is claimed is:

1. A scannable, beam-forming interferometer antenna array system, comprising:

a plurality of antenna elements spaced from one another by integral multiples of a portion of the wavelength of the signal frequency, at least three pairs of antenna elements being selectable from said plurality of antenna elements, first and second coherent local oscillators generating output signals having first and second frequencies, respectively, a first plurality of mixers twice the number of said plurality of antenna elements, each antenna element being connected to a pair of mixers of said first plurality of mixers, the first mixer of each pair of mixers being supplied with the output signal of said first coherent local oscillator and the second mixer of each pair of mixers being supplied with the output signal of said second coherent local oscillator, a second plurality of mixers, the inputs of each mixer of said second plurality of mixers being connected to the outputs of selected pairs of mixers of said first plurality of mixers to form interferometer pairs and obtain outputs having spatial frequencies determined by the spacing between the corresponding interferometer pairs, and a third plurality of mixers, the inputs of each mixer of said third plurality of mixers being connected to the outputs of selected pairs of mixers of said second plurality of mixers to obtain outputs having spatial harmonics corresponding to the interferometer pairs.

2. The interferometer antenna array system as recited in claim 1 wherein said plurality of antenna elements are spaced from one another by integral multiples of one-quarter wavelength of the signal frequency.

3. The interferometer antenna array system as recited in claim 1 wherein said second plurality of mixers is equal in number to said first plurality of mixers.

4. The interferometer antenna array system as recited in claim 1 wherein said third plurality of mixers is equal in number to said second plurality of mixers.

5. The interferometer antenna array system as recited in claim 1 wherein said first and second frequencies are both above said signal frequency.

6. The interferometer antenna array system as recited in claim 1 wherein said first and second frequencies are both below said signal frequency.

7. The interferometer antenna array system as recited in claim 1 wherein said first frequency is below said signal frequency and said second frequency is above said signal frequency.

8. The interferometer antenna array system as recited in claim 1 wherein said plurality of antenna elements are unequally spaced from one another in a linear array.

9. The interferometer antenna array system as recited in claim 8 wherein the number of antenna elements is four and the spacing between the first and second is $3\lambda/2$, the spacing between the second and the third is $10\lambda/2$, and the spacing between the third and the fourth is $2\lambda/2$.

* * * * *